United States Patent [19]

Ruckdeschel

[11] 4,043,293

[45] Aug. 23, 1977

54] DEVELOPABILITY REGULATING APPARATUS

75] Inventor: Frederick R. Ruckdeschel, Webster, N.Y.

73] Assignee: Xerox Corporation, Stamford, Conn.

21] Appl. No.: 682,230

22] Filed: May 3, 1976

51] Int. Cl.[2] ..... G03G 15/08

52] U.S. Cl. ..... 118/7; 118/646; 222/DIG. 1; 250/573

58] Field of Search ..... 118/7, 637, 646; 222/DIG. 1, 57

56] References Cited

U.S. PATENT DOCUMENTS

| | | | |
|---|---|---|---|
| 3,430,606 | 3/1969 | Pease et al. | 118/7 X |
| 3,526,338 | 9/1970 | Goodrich et al. | 222/57 X |
| 3,604,939 | 9/1971 | Maksymiak | 222/57 X |
| 3,635,373 | 1/1972 | Kuhl et al. | 118/7 |
| 3,727,065 | 4/1973 | Maksymiak | 222/DIG. 1 |
| 3,777,173 | 12/1973 | Landrith | 222/DIG. 1 |
| 3,791,744 | 2/1974 | Erny et al. | 118/7 X |
| 3,854,449 | 12/1974 | Davidson | 118/7 X |

*Primary Examiner*—Mervin Stein

*Attorney, Agent, or Firm*—J. J. Ralabate; C. A. Green; H. Fleischer

[57] ABSTRACT

An apparatus which regulates the developability characteristics of a development system employing a developer mixture comprising at least carrier granules and toner particles. A transparent electrode attracts toner particles from the carrier granules. Light rays are transmitted through the electrode with the particles thereon. Sensors having peak transmittances corresponding to the peak transmittance and absorbence of the toner particles, detect the intensity of the light rays transmitted through the electrode and generate electrical output signals indicative thereof. These signals are processed and a control signal is developed which regulates the dispensing of additional toner particles into the developer mixture. In this manner, the concentration of toner particles within the developer mix is adjusted.

16 Claims, 3 Drawing Figures

DEVELOPABILITY REGULATING APPARATUS

BACKGROUND OF THE INVENTION

This invention relates generally to an electrophotographic printing machine, and more particularly concerns an apparatus for regulating the developability of a development system employed therein.

In the process of electrophotographic printing, a charged photoconductive member is exposed to a light image of an original document being reproduced. The irradiated areas of the photoconductive surface are discharged to record thereon an electrostatic latent image corresponding to the original document. A development system moves a developer mix of carrier granules and toner particles into contact with the photoconductive surface. The toner particles are attracted electrostatically from the carrier granules to the latent image forming a toner powder image thereon. Thereafter, the toner powder image is transferred to a sheet of support material. After transferring the toner powder image to the sheet of support material, a fusing device permanently affixes the toner powder image thereto.

It is evident that in a printing machine of this type, toner particles are depleted from the developer mixture. As the concentration of toner particles decreases, the density of the resultant copy degrades. In order to maintain the copies being reproduced at a specified minimum density, it is ncessary to regulate the concentration of toner particles in the developer mixture. This is the function of the developability regulating apparatus.

Developability, as it pertains to an electrophotographic printing machine is the ability of the developer mixture to develop the image with at least a minimum specified density. The regulating apparatus adjusts the characteristics of the developer mixture to achieve the foregoing.

Primarily, developability is related to the concentration of toner particles in the developer mixture, i.e., the percentage of toner particles relative to carrier granules therein. Other factors effect developability such as temperature and humidity conditions as well as the physical parameters of the development system such as spacing, electrical bias, mass flow rate, and the magnetic field pattern, amongst others. Numerous systems have been developed for controlling the concentration of toner particles within a developer mixture so as to maintain the resultant image density at least at a minimum value. For example, U.S. Pat. No. 3,635,373 issued to Kuhl et al. in 1972 discloses a system employing two parallel spaced conductive plates through which the developer mixture flows. The plates are connected to a circuit wherein each is electrically charged alternately for equal periods of a time to attract and repel toner particles. A light source is located on one side of the two plates with a photocell being located at the other side to sense the illumination intensity transmitted therethrough. The photocell develops an electrical signal which is processed to form an error signal. The error signal controls the dispensing of toner particles into the developer mix. Another patent is U.S. Pat. No. 3,757,999 issued to Maksymiak in 1973. This patent teaches the use of spaced conductive plates alternately electrically charged between which the developer mix flows. A light source is positioned on one side of the two plates and a photocell on the other side thereof. In this way, the intensity of the light rays passing therethrough is detected. This system also provides a measurement of the toner particles concentration within the developer mix. Still another patent disclosing a system of this type is U.S. Pat. No. 3,376,854 issued to Kamola in 1968. Kamola describes a toner concentration control system wherein two parallel spaced conductive plates define a channel through which developer mix passes. One plate has a pattern thereon which is held to an electrical potential to attract the toner particles from the developer mixture. A light source and photocell are positioned with the plates interposed therebetween. Another photocell is arranged as a leg of a bridge circuit which includes the first photocell. In this way, an unbalance in the bridge causes toner particles to be dispensed to the developer mixture.

It has been found that devices hereinbefore employed frequently have significant signal fluctuations due to the developer flow between the plates. This significantly reduces the control accuracy of the system.

Accordingly, it is a primary object of the present invention to improve the control accuracy of a developability regulating apparatus.

SUMMARY OF THE INVENTION

Briefly stated, and in accordance with the present invention, there is provided an apparatus for regulating the developability of a development system employing particles.

Pursuant to the features of the present invention, the apparatus includes transparent electrode means electrically biased to attract particles thereto. Illuminating means irradiate the electrode means having particles deposited thereon with light rays. Means are provided for sensing the intensity of the light rays transmitted through the electrode means. The sensing means has peak transmittances corresponding to the peak transmittance and absorbence of the particles. Electrical output signals, indicative of the intensity of the light rays transmitted thereto, are developed by the sensing means.

BRIEF DESCRIPTION OF THE DRAWINGS

Other objects and advantages of the present invention will become apparent upon reading the following detailed description and upon reference to the drawings, in which.

Figure 3:
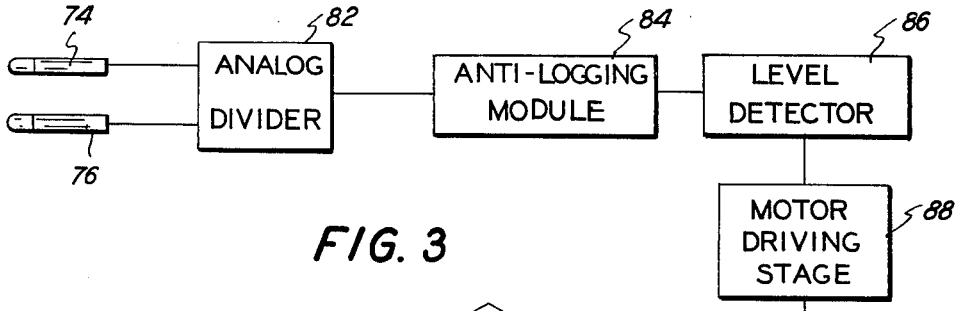
FIG. 3 is a block diagram depicting the control system used with the FIG. 2 developability regulating apparatus.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

For a general understanding of an electrophotographic printing machine incorporating the features of the present therein, continued reference is had to the drawings. In the drawings, like reference numerals have been used throughout to designate identical elements.

Although the developability regulating apparatus of the present invention is particularly well adapted for use in a color electrophotographic printing machine, it should become evident from the following discussion that it is equally well suited for use in a wide variety of electrostatographic printing machines or other devices and is not necessarily limited to the particular embodiment shown herein.

Figure 1:
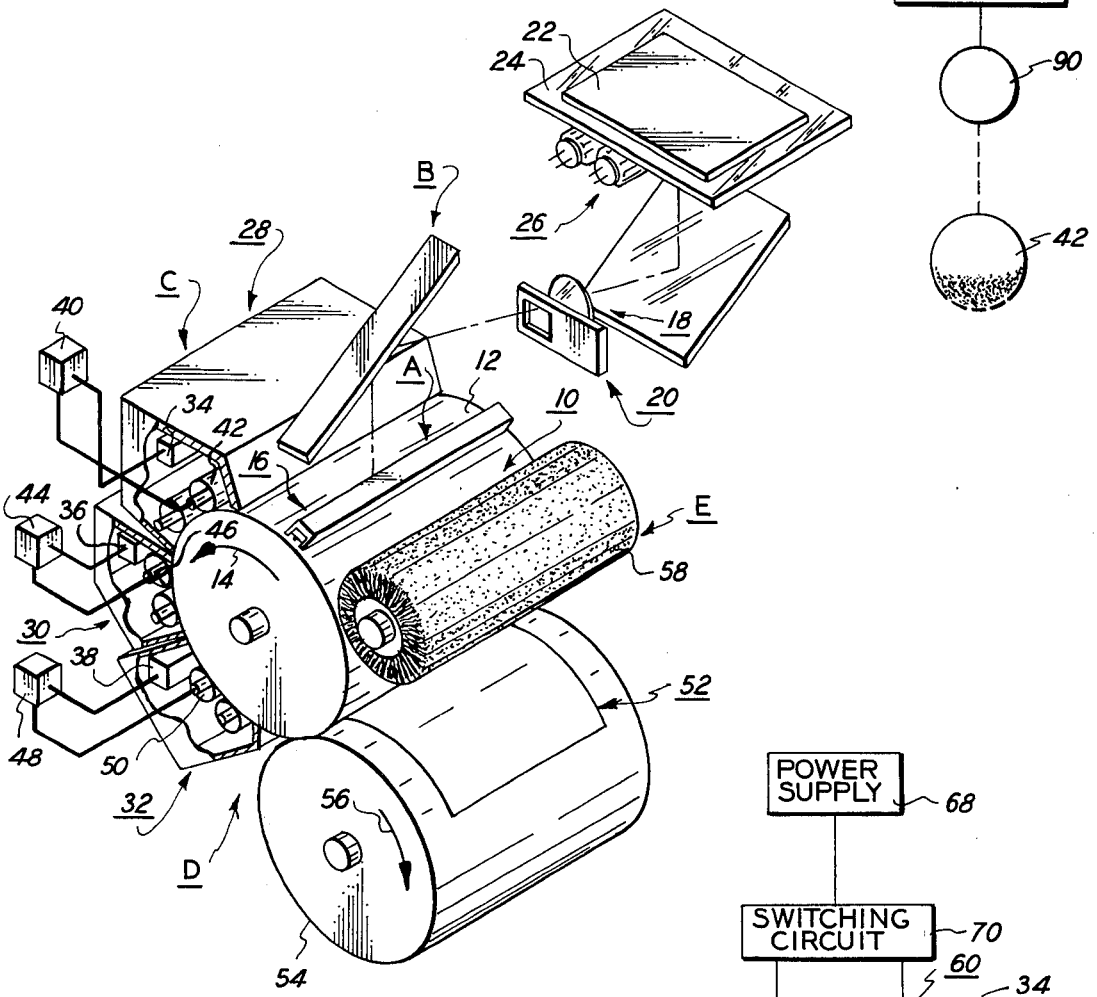
FIG. 1 is a schematic perspective view depicting an electrophotographic printing machine embodying the features of the present invention therein.

An illustrative schematic of the electrophotographic printing machine is shown in FIG. 1. As depicted therein, the electrophotographic printing machine employs a photoconductive member having a drum 10 mounted rotatably within the machine frame (not shown) with photoconductive surface 12 secured thereto and entrained thereabout. Preferably, photoconductive surface 12 is made from a suitable panchromatic selenium alloy such as is described in U.S. Pat. No. 3,655,377 issued to Sechak in 1972.

As drum 10 rotates in the direction of arrow 14, the charged portion of photoconductive surface 12 passes through a series of processing stations disposed about the periphery thereof. Drum 10 is rotated at a substantially constant angular velocity so that the proper sequencing of events may occur at each of the processing stations. Timing for each event is achieved by a signal generator (not shown) operatively associated with drum 10. The signal generator develops electrical pulses which are processed by the machine logic so that each station is activated at the appropriate time during the rotation of drum 10.

Initially, drum 10 rotates through charging station A. At charging station A, a corona generating device, indicated generally by the reference numeral 16, charges at least a portion of photoconductive surface 12 to a relatively high, substantially uniform level. A suitable corona generating device is described in U.S. Pat. No. 3,875,407 issued to Hayne in 1975.

After photoconductive surface 12 is charged to a substantially uniform level, drum 10 rotates the charged portion thereof to exposure station B. Exposure station B includes a moving lens system, generally designated by the reference numeral 18, and a color filter mechanism, shown generally at 20. An original document 22 is supported stationarily upon transparent viewing platen 24. Lamp assembly 26 disposed beneath platen 24 illuminates successive incremental areas of original document 22 during the scanning thereof. Lens system 18, filter mechanism 20, and lamps 26 move in a timed relationship with the rotation of drum 10 to project a color filtered flowing light image of original document 22 onto the charged portion of photoconductive surface 12. During exposure, filter mechanism 20 interposes selected color filters into the optical light path of lens 18. The selected color filter operates on the light passing through lens 18 to record an electrostatic latent image on photoconductive surface 12 corresponding to a specific color of the informational areas contained in original document 22.

After the electrostatic latent image is recorded on photoconductive surface 12, drum 10 rotates to development station C. At development station C, three individual developer units, generally indicated by the reference numerals 28, 30 and 32, respectively, are arranged to render visible the electrostatic latent image recorded on photoconductive surface 12. Preferably, each of the developer units are of the type generally referred to in the art as "magnetic brush developer units." A typical magnetic brush developer unit employs a developer mix which includes a magnetic carrier granules and heat settable toner particles adhering thereto triboelectrically. In operation, the developer mix is continually brought through a directional flux field forming a chain-like array of fibers extending outwardly from the developer unit. This chain like array of fibers is frequently termed a brush. The electrostatic latent image recorded on photoconductive surface 12 rotates into contact with the brush of developer mix. Toner particles are attracted from the carrier granules to the latent image. Each of the developer units contain appropriately colored toner particles. For example, a green filtered light image is developed by depositing magenta toner particles thereon. Similarly, a red filtered light image is developed with cyan toner particles and a blue filtered light image with yellow toner particles. A development system of this type is described in U.S. Pat. No. 3,854,449 issued to Davidson in 1974.

In accordance with the features of the present invention, additional toner particles are added to each of the developer mixtures, when the developability, as hereinbefore described, is reduced deleteriously. More particularly, the developability regulating system, indicated generally by the reference numerals 34, 36 and 38, respectively, detect the concentration of toner particles within each of the developer mixes contained in developer units 28, 30 and 32. The developability regulating systems are substantially identical to one another with the major distinction being the color of the toner particles employed with the corresponding developer unit. Thus, each developability regulating system senses when the toner particle concentration within the developer mix is beneath a predetermined level. At that time, an error signal is developed which controls dispensing of additional toner particles to the respective developer mixture. For example, developer regulating apparatus 34 senses the toner particle concentration within developer unit 28. An electrical output signal indicative of the detected toner particle concentration is processed by circuitry 40 and an error signal is developed. The error signal controls a motor which oscillates toner cartridge 42 to dispense additional toner particles into the developer mixture. Similarly, regulating apparatus 36 measures the concentration of toner particles in developer unit 30 and develops an electrical output signal indicative thereof. This electrical output signal is processed by control circuit 44 which generates an error signal for regulating a motor which oscillates toner cartridge 46 to dispense additional particles into the developer mixture. Finally, developability regulating apparatus 38 detects the concentration of toner particle in developer unit 32. Developability regulating apparatus 38 generates an electrical signal indicative of the toner particle concentration within developer unit 32. This electrical signal is processed by control circuit 48, which, in turn, develops an error signal for energizing the power supply controlling a motor which oscillates toner cartridge 50. Toner cartridge 50 dispenses additional toner particles into the developer mix of developer unit 32. The detailed structure of developability regulating apparatus 34 will be described hereinafter with reference to FIGS. 2 and 3.

After the single color electrostatic latent image is developed, drum 10 rotates to transfer station D. At transfer station D, the toner powder image adhering electrostatically to photoconductive surface 12 is transferred to a sheet of support material 52. Support material 52 may be a sheet of paper of a plastic material, amongst others. Transfer station D includes an electrically biased transfer roll shown generally at 54 supporting a sheet of support material 52 releasably thereon. Transfer roll 52 recirculates support material 54 and is electrically biased to a potential of sufficient magnitude and polarity to attract the toner particles from the electrostatic latent image recorded on photoconductive surface 12 to support material 52. Transfer roll 54 rotates in the direction of arrow 56, in synchronism with drum 10, to maintain support material 52, secured releasably thereon, rotating in registration with the toner powder image developed on photoconductive surface 12. In this manner, successive toner powder images may be transferred to support material 52 in superimposed registration with one another. A suitable transfer system is described in U.S. Pat. No. 3,838,918 issued to Fisher in 1974.

After the last transfer operation, support material 52 is stripped from transfer roll 54 and advanced to a fusing station (not shown) where the transferred image is permanently affixed to a support sheet 52. Thereafter, support sheet 52 is advanced to a catch tray by a plurality of endless conveyors for subsequent removal by the machine operator.

Prior to proceeding with the remaining processing stations, the sheet feeding apparatus will be briefly described. Support material 52 is advanced from a stack mounted on a tray. A feed roll, in operative communication with a retard roll, advances and separates the uppermost sheet from the stack. The advancing sheet moves into a chute which directs it into the nip between a pair of register rolls. The register rolls align and forward the sheet to gripper fingers which secure it releasably on transfer roll 54. After the requisite number of toner powder images have been transferred to support material 52, the gripper fingers release support material 52 and space it from transfer roll 54. As transfer roll 54 continues to rotate in the direction of arrow 56, a stripper bar is interposed therebetween. In this way, support material 52 passes over the stripper bar onto an endless belt conveyor. The endless belt conveyor advances the sheet of support material with the toner particles deposited thereon to the fusing station.

Although a perponderance of the toner particles are transferred to support material 52, invariably some residual toner particles remain adhering to photoconductive surface 12 after the transfer process. These residual toner particles are removed from photoconductive surface 12 at cleaning station E. Cleaning station E includes a corona generating device (not shown) for neutralizing the electrostatic charge remaining on the residual toner particles and photoconductive surface 12. The neutralized toner particles are then cleaned from photoconductive surface 12 by a rotatably mounted fibrous brush 58 in contact therewith. A suitable brush cleaning device is described in U.S. Pat. No. 3,590,412 issued to Gerbasi in 1971.

It is believed that the foregoing description is sufficient for purposes of the present application to illustrate the general operation of a color electrophotographic printing machine incorporating the features of the present invention therein.

Figure 2:
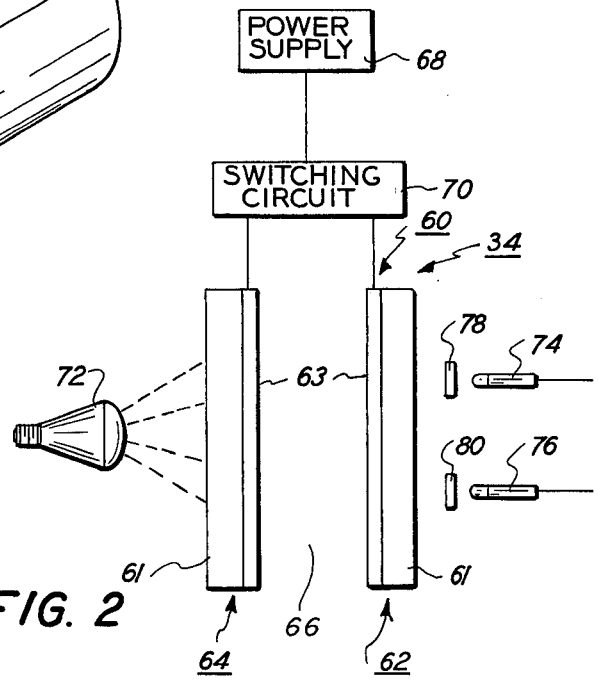
FIG. 2 is a schematic illustration of a developability regulating apparatus employed in the FIG. 1 printing machine.

Referring now to FIG. 2, the specific characteristics of the developability regulating apparatus employed in the FIG. 1 printing machine will be discussed hereinafter. Only developability regulating apparatus 34 will be discussed, in detail, inasmuch as developability regulating apparatus 36 and developability apparatus 38 are substantially identical thereto. Any distinctions between the developability regulating systems will be pointed out during the discussion of developability regulating apparatus 34. Similarly, only control circuit 40 and dispensing cartridge 42 will be described inasmuch as control circuits 44 and 48 are substantially identical to circuit 40, and dispensing cartridges 46 and 50 are substantially identical to cartridge 42.

Each dispensing cartridge houses a supply of selected toner particles to form a reservoir of the toner particles for the appropriate developer unit. For example, dispensing cartridge 42 of developer unit 28 houses cyan toner particles, dispensing cartridge 46 of developer unit 30 stores magenta toner particles, and dispensing cartridge 50 of developer unit 32 stores yellow toner particles. Each of the dispensing cartridges is cylindrical and includes perforations in the bottom portion thereof to meter therefrom a specified quantity of toner particles to the corresponding developer unit when oscillated. A suitable motor oscillates the dispensing cartridge to shear the toner particles contained therein and to dispense them through the perforations in the container to the corresponding developer mixture. Regulating systems 34, 36 and 38 control the dispensing of their corresponding dispensing cartridges by regulating the oscillation thereof.

With continued reference to FIG. 2, developability regulating apparatus 34 comprises a transparent electrode assembly 60. Transparent electrode assembly 60 comprises a pair of parallel spaced-apart conductive plates 62 and 64. The plates define a passageway 66 through which the developer mixture flows. Plates 62 and 64 are identical to one another. By way of example, each plate is made from a substantially rectangular glass sheet 61 having a transparent tin oxide coating 63 thereon. This type of transparent, electrically conductive glass is made by Pittsburgh Plate Glass under the tradename NESA or made by the Corning Glass Company under the tradename Electro Conductive.

In operation, plates 62 and 64 have an electrical potential of a particular polarity impressed thereon to attract and retain toner particles. This potential is applied alternately to plates 62 and 64. As one of the plates is electrically charged to attract toner particles, the other has applied thereto a charge of a polarity which will repel toner particles therefrom during this time. As each of the plates are alternately charged positively and negatively, each plate during a cycle will attract toner particles for a short period of time and then immediately repel the same toner particles. During the second half of each cycle, wherein toner particles are repelled, the continuously flowing developer mixture moving between the plates will clean the particular plate having the repelling charge thereon.

Plate 62 and 64 are alternately electrically biased to a voltage of about 200 volts. This is achieved by voltage source or power supply 68 coupled to plates 62 and 64, respectively, through switching circuit 70. A suitable switching circuit and power supply arrangement for alternately electrically biasing each of the plates is described in U.S. Pat. No. 3,635,373 issued to Kuhl et al. in 1972, the relevant portion thereof being hereby incorporated into the present application.

One skilled in the art will appreciate that it is not necessary to alternately switch the electrical bias on plate 62 and 64, but, in lieu thereof, one plate may be electrically biased to a suitable potential so as to attract toner particles thereto. In this mode of operation, the toner particles must be periodically cleaned from the plate.

Light source 72 illuminates plates 62 and 64. Preferably, light source 72 is a de-rated tungsten lamp with a regulated voltage, e.g., a 7 volt tungsten filament lamp operating from a 5 volt source. The light rays from light source 72 are transmitted through plates 62 and 64 and detected by photosensors 74 and 76, respectively. Photosensors 74 and 76 may be commerically available silicon phototransistors such as is produced by the General Electric Company, Model No. L114B. Optical filters 78 and 80 are interposed between plate 62 and photosensor 74 and 76, respectively. The peak transmittance of optical filter 78 corresponds to the peak transmittance of the toner particles flowing through passageway 66. Contrawise, the peak transmittance of optical filter 80 corresponds to the peak absorbence of the toner particles flowing through passageway 66. Thus, it is evident that different filters will be employed in each of the developer units. Hence, developability regulating apparatus 34 utilizes optical filter 78 which has a peak transmittance corresponding to the peak transmittance of cyan toner particles, while the peak transmittance of optical filter 80 corresponds to the peak absorbence of cyan toner particles. Contrawise, developability regulating apparatus 36 will employ optical filters having their peak transmittance and peak absorbence corresponding to magenta toner particles. Developability regulating apparatus 38 utilizes optical filters having their peak transmittance corresponding to the peak transmittance and peak absorbence of yellow toner particles. For example, the yellow toner particles may have their peak transmittance at about 550 nanometers and its peak absorbence at about 450 nanometers. The cyan toner particles will have their peak transmittance at about 450 nanometers and its peak absorbence at about 660 nanometers. Finally, the magenta toner particles will have their peak absorbence at about 560 nanometers and its peak transmittance at about 420 nanometers. Thus filter 78 has its peak transmittance in the region of from 350 to 560 nanometers and its peak absorbence in the region of from 560 to 700 nanometers. Contrawise, filter 80 has its peak transmittance in the region of from 560 to 700 nanometers and its peak absorbence in the region of from 350 to 560 nanometers. One of the optical filters employed with developability regulating apparatus 36 has its peak transmittance in the region of from 400 to 475 nanometers and its peak absorbence in the region of from 475 to 600 nanometers. The other optical filter employed in developability regulating apparatus 36 has its peak absorbence in the region of from 400 to 475 nanometers and its peak transmittance in the region of from 475 to 600 nanometers. One of the optical filters employed in developability regulating apparatus 38 has its peak absorbence in the region of from 350 to 500 nanometers and its peak transmittance in the region of from 500 to 625 nanometers. The other optical filter employed with developability regulating apparatus 38 has its peak transmittance in the region of from 350 to 500 nanometers and its peak absorbence of from 500 to 600 nanometers. Thus, it is evident that six different optical bandpass filters are employed, each path corresponding to the differently colored toner particles employed with the respective developer unit. Assuming that transparent non-light scattering toner particles are employed, the electrical output signal from photosensor 76 may be expressed as:

$$I_A = I_O T_D T_{TA};$$

and the electrical output signal from photosensor 74 may be expressed as:

$$I_T = I_O T_D T_{TT};$$

where $T_D$ is the transmittance of the carrier;

$T_{TA}$ is the transmittance of color toner in its absorbence region;

$T_{TT}$ is the transmittance of color toner in its transmittance region; and $I_O$ is the initial light beam intensity. Referring now to FIG. 3, the electrical output signal from photosensors 74 and 76 are processed by analog divider 82 to obtain the ratio therebetween. Diode function generators may be employed in analog divider 82 to obtain the ratio between the electrical output signal from photosensor 74 and the electrical output signal from photosensor 76. Circuitry of this type is described in the Control Engineer's Handbook, published by the McGraw-Hill Book Company, Inc. in 1958 on pages 5–14 and 5–15 thereof, the relevant portions being hereby incorporated into the present application. The electrical output signal from analog divider 82 corresponds to:

$$\text{Signal (1)} = T_{TA}/T_{TT}$$

Circuit 84 determines the anti-logarithm of this signal. The anti-logarithm of this signal may be generated by means of diodes. A suitable anti-logarithm circuit is also described in the Control Engineer's Handbook published by the McGraw-Hill Book Company, Inc. in 1958 on pages 5–15 thereof, the relevant portions being hereby incorporated into the present application.

Under the assumption that Beer's law governs, $$T_{TA} = e^{-AM};$$

and $$T_{TT} = e^{-TM}$$

where

A and T are respective extinction coefficients; and

M is the toner mass deposition on plates 62 and 64.

The electrical output signal from anti-logging module 84 is:

$$\text{Signal (2)} = KM$$

where $K$ is a constant.

This is a linear signal and a produces a significant reduction in signal fluctuation due to developer flow, thereby providing greater control accuracy.

The linear electrical output signal from anti-logging module 84 is processed by level detector 86. Level detector 86 preferably includes a suitable discriminator circuit for comparing a reference with the linear electrical output signal from antilogging module 84. The discriminating circuit may utilize a silicon control switch which turns on and effectively locks in after an electrical output signal has been obtained having a magnitude greater than the reference level (i.e., set point). This signal from the discriminator circuit changes the state of a flip-flop to develop an output signal therefrom. The output signal from the flip-flop, in conjunction with an output signal from the appropriate developer unit actuates an AND gate which, in turn, transmits a control signal. The control signal also resets the flip-flop. The control signal from level detector 86 energizes the motor driving stage 88 of the power supply energizing motor 90. Motor 90, in turn, oscillates toner cartridge 42 to dispense toner particles through the perforations therein into developer unit 28. In this manner, the toner particle concentration of the developer mixture in development unit 28 is adjusted to the desired level.

Hence, the developability regulating apparatus of the present invention develops a signal indicative of the toner particle concentration within the developer mix which is substantially independent of flow rate and has little fluctuations. This signal provides greater system control and accuracy.

It is, therefore, apparent that there has been provided, in accordance with the present invention, an apparatus for regulating the developability of a development system that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for regulating the developability of a development system employing particles, including:

transparent electrode means electrically biased to attract particles thereto, means for illuminating said electrode means having particles deposited thereon with light rays;

first means, having a peak transmittance corresponding to the peak transmittance of the particles, for detecting the intensity of the light rays transmitted through the particles adhering to said electrode means and generating a first electrical signal indicative thereof; and second means, having a peak transmittance corresponding to the peak absorbence of the particles, for detecting the intensity of the light rays transmitted through the particles adhering to said electrode means and generating a second electrical signal indicative thereof.

2. An apparatus as recited in claim 1, wherein said sensing means includes first circuit means for dividing the first electrical signal by the second electrical signal to produce an electrical output signal indicative of the ratio therebetween.

3. An apparatus as recited in claim 2, wherein said sensing means includes second circuit means for processing the electrical output signal to determine the anti-logarithm thereof to form a substantially linear electrical signal.

4. An apparatus as recited in claim 3, further including:

means for comparing the linear electrical signal with a reference to produce a control signal; and means, actuated by the control signal, for dispensing particles into the development system to achieve the requisite system developability.

5. An apparatus as recited in claim 1, wherein said electrode means includes:

a pair of spaced-apart conductive plates defining a passageway through which the particles flow; and means for electrically biasing at least one of said pair of plates.

6. An apparatus as recited in claim 5, wherein said biasing means produces cyclically an electrical charge on first one then the other of said pair of plates capable of attracting particles thereto so that the particles are attracted to one of said pair of plates and, substantially simultaneously therewith, released from the other of said pair of plates.

7. An apparatus as recited in claim 1, wherein said first detecting means includes:

a first photosensor positioned in a light receiving relationship with the light rays transmitted through said electrode means; and a first optical filter interposed in the path of the light rays transmitted to said first photosensor, said first optical filter having a peak transmittance corresponding to the peak transmittance of the particles.

8. An apparatus as recited in claim 7, wherein said second detecting means includes:

a second photosensor positioned in a light receiving relationship with the light rays transmitted through said electrode means; and a second optical filter interposed in the path of the light rays transmitted to said second photosensor, said second optical filter having a peak transmittance corresponding to the peak absorbence of the particles.

9. An electrophotographic printing machine of the type having a development system employing a developer mix comprising at least toner particles and carrier granules with the concentration of toner particles therein being regulated, including:

transparent electrode means electrically biased to attract thereto toner particles from the carrier granules;

means for illuminating said electrode means having toner particles deposited thereon with light rays;

first means, having a peak transmittance corresponding to the peak transmittance of the particles, for detecting the intensity of the light rays transmitted through the particles adhering to said electrode means and generating a first electrical signal indicative thereof; and second means, having a peak transmittance corresponding to the peak absorbence of the particles, for detecting the intensity of the light rays transmitted through the particles adhering to said electrode means and generating a second electrical signal indicative thereof.

10. A printing machine as recited in claim 9, wherein said sensing means includes first circuit means for dividing the first electrical signal by the second electrical signal to produce an electrical output signal indicative of the ratio therebetween.

11. A printing machine as recited in claim 10, wherein said sensing means includes second circuit means for processing the electrical output signal to determine the antilogarithm thereof to form a substantially linear electrical signal.

12. A printing machine as recited in claim 11, further including:

means for comparing the linear electrical signal with a reference to produce a control signal; and means, actuated by the control signal, for dispensing toner particles into the development system to achieve the requisite concentration thereof.

13. A printing machine as recited in claim 9, wherein said electrode means includes:

a pair of spaced-apart conductive plates defining a passageway through which the developer mix flows; and means for electrically biasing at least one of said pair of plates.

14. A printing machine as recited in claim 13, wherein said biasing means produces cyclically an electrical charge on first one then the other of said pair of plates capable of attracting toner particles thereto so that the toner particles are attracted to one of said pair of plates and, substantially simultaneously therewith, released from the other of said pair of plates.

15. A printing machine as recited in claim 9, wherein said first detecting means includes:

a first photosensor positioned in a light receiving relationship with the light rays transmitted through said electrode means; and a first optical filter interposed in the path of the light rays transmitted to said first photosensor, said first optical filter having a peak transmittance corresponding to the peak transmittance of the toner particles.

16. A printing machine as recited in claim 15, wherein said second detecting means includes:

a second photosensor positioned in a light receiving relationship with the light rays transmitted through said electrode means; and a second optical filter interposed in the path of the light rays transmitted to said second photosensor, said second optical filter having a peak transmittance corresponding to the peak absorbence of the toner particles.

* * * * *